US006439839B1

(12) United States Patent
Song et al.

(10) Patent No.: US 6,439,839 B1
(45) Date of Patent: Aug. 27, 2002

(54) BLOWER

(75) Inventors: Sung Bae Song, Seoul; Sung Il Park, Anyang-si; Joon Sei Lee, Seoul, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/628,649

(22) Filed: Jul. 28, 2000

(30) Foreign Application Priority Data

Aug. 10, 1999 (KR) ..... 99-32817
Nov. 27, 1999 (KR) ..... 99-53256

(51) Int. Cl.[7] ..... F01D 25/04
(52) U.S. Cl. ..... 415/119; 415/204; 415/206; 415/212.1
(58) Field of Search ..... 415/204, 206, 415/119, 212.1

(56) References Cited

U.S. PATENT DOCUMENTS 3,846,040 A * 11/1974 Dennis ..... 415/206
4,799,287 A * 1/1989 Belanger et al. ..... 415/206
4,900,225 A * 2/1990 Wulf et al. ..... 415/212.1
5,399,068 A * 3/1995 Park ..... 415/204
5,474,422 A * 12/1995 Sullivan ..... 415/206
5,813,834 A * 9/1998 Hopfensperger et al. ... 415/206
6,050,772 A * 4/2000 Hatakeyama et al. ..... 416/206
6,142,732 A * 11/2000 Chou et al. ..... 415/204

* cited by examiner

*Primary Examiner*—Edward K. Look
*Assistant Examiner*—James M. McAleenan
(74) *Attorney, Agent, or Firm*—Birch, Stewart, Kolasch & Birch, LLP

(57) ABSTRACT

A blower is disclosed. The blower comprises an impeller and a scroll housing. The impeller is provided with a plurality of blades and rotated. The scroll housing guides and discharges air sucked by the impeller to the outside, and surrounds the impeller. The expansion angle of the curvature radius of the contour of the scroll housing is designed to be less than an expansion angle in conformity with an Archimedic curve in a suction region ranging from a cutoff start angle to 160–200° from a reference angle. Additionally, the expansion angle of the curvature radius of the contour of the scroll housing is designed to be greater than the expansion angle in conformity with the Archimedean curve in a discharge region ranging exceeding 160–200°.

10 Claims, 8 Drawing Sheets

BLOWER

BACKGROUND OF THE INVENTION

1. Field of the Invention

The present invention relates, in general, to a blower that is referred to as a sirocco fan and, more particularly, to a blower, which is capable of increasing its blowing efficiency while reducing its noise, in such a way that the expansion angle of its scroll housing is increased in a discharge region and discharge guides are mounted to the discharge opening of the scroll housing for reducing the flow resistance of air.

2. Description of the Prior Art

Generally, a sirocco fan is a blower that is widely employed in household electronic appliances. An example of such a sirocco fan that is applied to a combined electronic range and hood is illustrated in FIG. 1.

The combined electronic range and hood shown in FIG. 1 comprises a case 1, a cavity 5 provided in the case 1 for positioning food for cooking, a magnetron 3 for radiating electronic waves to the interior of the cavity 5, a fan 4 for cooling the magnetron 3, a pair of blowers 10 positioned over the cavity 5 for discharging smoke, which is generated in a gas range (not shown) disposed beneath the case 1, to the outside by means of a drive motor 2, and a discharge passage formed in the side portions of the case 1 for allowing the smoke generated in the gas range to be moved. The smoke that is sucked from an inlet positioned on the bottom of the case 1 rises through the discharge passage, flows through the blowers 10, and is discharged to the outside through a connecting duct 21.

As illustrated in FIG. 2, each of the blowers 10 comprises an impeller 11 for sucking air and a scroll housing 12 for guiding and discharging the air sucked by the impeller 11 to a discharge opening 12*b*.

The impeller 11 comprises a plurality of blades 11*a* retained by means of a rib 11*b* and is connected to the drive motor. The scroll housing 12 is designed in such a way that air is sucked through an inlet 12*a* while being guided by a bell mouth 13, and discharged through a discharge opening 12*b* while flowing through a passage that is gradually enlarged from a cutoff position C. In other words, when the impeller 11 connected to the drive motor is rotated, air in front of the inlet 12*a* is sucked, moved to the discharge opening 12*b* along the gradually expanded passage of the scroll housing 12, and is discharged to the outside. Therefore, since noise and air flow rate generated in the blower 10 are varied sensitively in accordance with the design of the scroll housing 12, attempts have been made to reduce the noise and increase the air flow rate.

In FIGS. 2 and 3, reference characters $\theta_0$, $\theta_c$, and $\theta_x$ respectively denote a reference angle, a cutoff start angle measured counterclockwise from the reference angle $\theta_0$ to a cutoff start position and an optional angle measured counterclockwise from the reference angle $\theta_0$ to an optional position.

FIG. 3 is a front view showing the scroll housing of the conventional blower that is designed using an Archimedic curve and an exponential curve. FIG. 4 is a graph wherein expansion angles are plotted for a case where the scroll housing of the conventional blower is designed using the Archimedic curve and the exponential curve.

As shown in FIGS. 3 and 4, such a conventional scroll housing may be classified into one type that is designed using the Archimedic curve or another type that is designed using an exponential curve.

In a method of constructing the contour of the scroll housing 12 using the Archimedic curve, its curvature radius is increased proportionally according to a mean velocity theory when the contour of the scroll housing 12 has been determined. When an expansion angle is $\alpha$, the curvature radius $R_x$ of the scroll housing at a position, where an angle measured from the reference angle $\theta_0$ is $\theta_x$, is calculated by the following equation 1.

$$R_x=R_o\times(1+\theta_x\times\pi/180\times\tan\alpha) \qquad \text{Equation 1}$$

wherein $R_o$ denotes the radius of the impeller.

In a scroll housing 20 constructed using an exponential curve in which its curvature radius is increased exponentially, the curvature radius $R_x$ of the scroll housing is calculated by the following equation 2 when an expansion angle is $\alpha e$ and an angle measured from the reference angle $\theta_0$ is $\theta_x$.

$$R_x=R_o\times\exp(\tan\alpha e\times\theta_x\times 90/180) \qquad \text{Equation 2}$$

However, in the conventional blower, since the sum of a curvature radius R180 when the angle $\theta_x$=180° and a curvature radius R360 when the angle $\theta_x$=360° is the width of the scroll housing in a case where the Archimedic curve is used and the width of the scroll housing is fixed, the expansion angle $\alpha$ is fixed when the radius $R_o$ of the impeller is determined. For example, when the radius $R_o$ of the impeller is 40 mm and the width of the scroll housing is restricted to 105 mm, the expansion angle in the Archimedic curve is 3.799°. Therefore, since the expansion angle, which influences the air flow rate, is fixed if the radius of the impeller and the width of the scroll housing are fixed, the radius of the impeller should be reduced so as to increase the expansion angle. However, this causes problems wherein flowing performance is reduced and noise is increased.

Additionally, when the widths of the scroll housing are the same, the scroll housing that is constructed using the exponential curve has a small curvature radius in comparison with the scroll housing that is constructed using the Archimedic curve.

On the other hand, in order to improve the discharge performance by increasing the air flow rate of the combined electronic range and hood shown in FIG. 1, the width W and the entire length $L_v$ of the blower 10 shown in FIG. 5 should be increased.

In order to increase the width W of the blower 10, inner cooking space, or the cavity 5 should be reduced in a same-sized combined electronic range and hood. In order to increase the entire length of the blower 10, the length Lh of the discharge opening 12*b* should be increased. In such a case, the air flow rate can be increased while flow loss and generation of noise are minimized.

However, since the width Ld of the connecting duct 21 is restricted to a certain standard size in the combined electronic range and hood that is generally used in kitchens and shown in FIG. 1, the length Lh of the discharge opening of the scroll housing in communication with the connecting duct 21 should be restricted even though the entire length Lv of the blower 10 shown in FIG. 5 is designed to be greater.

As a result, if the length Lv of the blower 10 is increased under a condition that the size of the discharge opening 12*b* of the scroll housing 12 is restricted, the flow loss is increased in the side space Z of the discharge opening 12*b* and the scroll housing 12. Consequently, the air flow rate is scarcely increased and the collision of flow is increased, so that severe noise is generated.

SUMMARY OF THE INVENTION

Accordingly, the present invention has been made keeping in mind the above problems occurring in the prior art, and an object of the present invention is to provide a blower, in which its expansion angle is reduced in a region of air suction and its expansion angle is increased in a region of air discharge, thereby improving flowing performance and reducing noise.

Another object of the present invention is to provide a blower, which is capable of reducing flow loss that is generated when air is discharged by forming a discharge guide in a scroll housing, thereby improving the discharge performance of air.

In order to accomplish the above object, the present invention provides a blower, comprising an impeller provided with a plurality of blades and a scroll housing for guiding and discharging air sucked by the impeller to the outside, the scroll housing surrounding the impeller, wherein the expansion angle of the curvature radius of the contour of the scroll housing is to be less than an expansion angle in conformity with an Archimedic curve in a suction region ranging from a cutoff start angle to 160–200° from a reference angle and to be greater than the expansion angle in conformity with the Archimedic curve in a discharge region ranging exceeding 160–200° from the reference angle.

In addition, the present invention provides a blower, comprising a scroll housing, an impeller, and guide means mounted to a discharge opening of said scroll housing.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
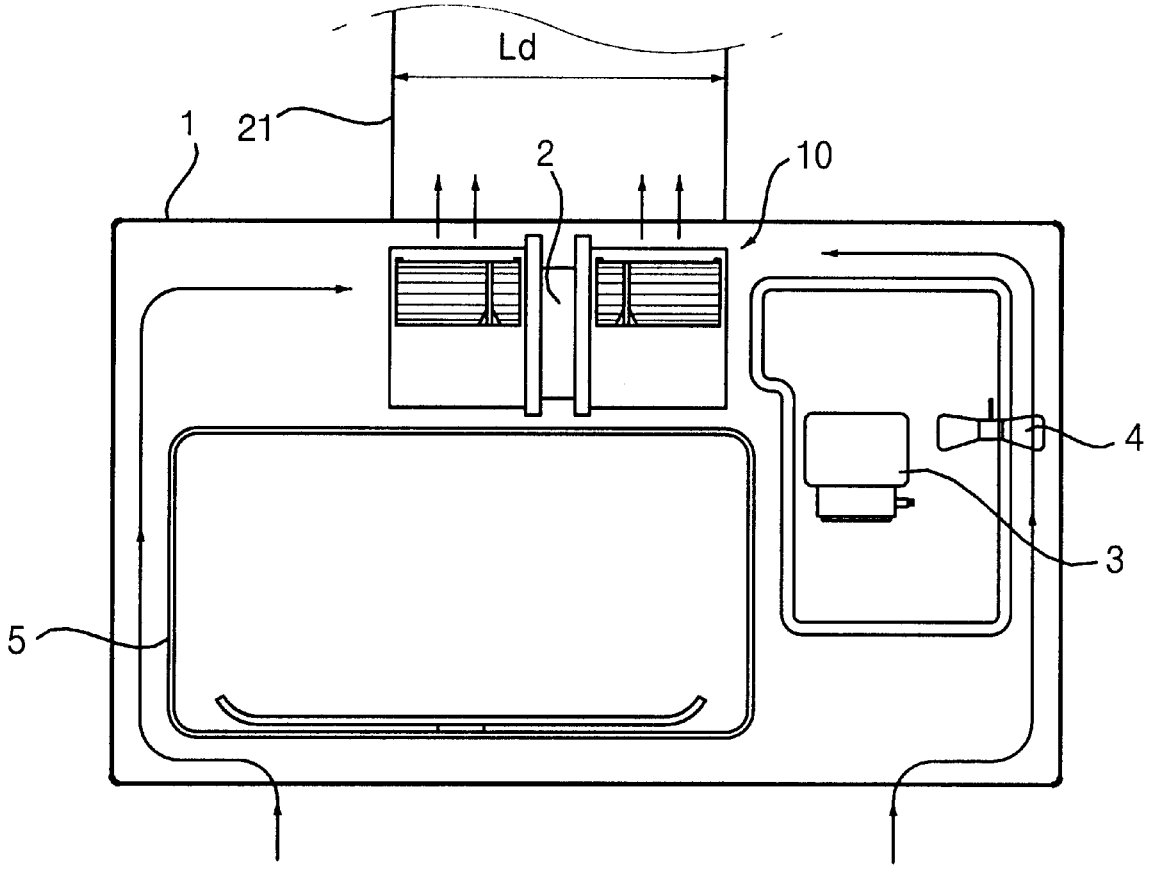
FIG. 1 ( Prior Art )
FIG. 1. is a plan view shown a conventional combined electronic range and hood.
Figure 2:
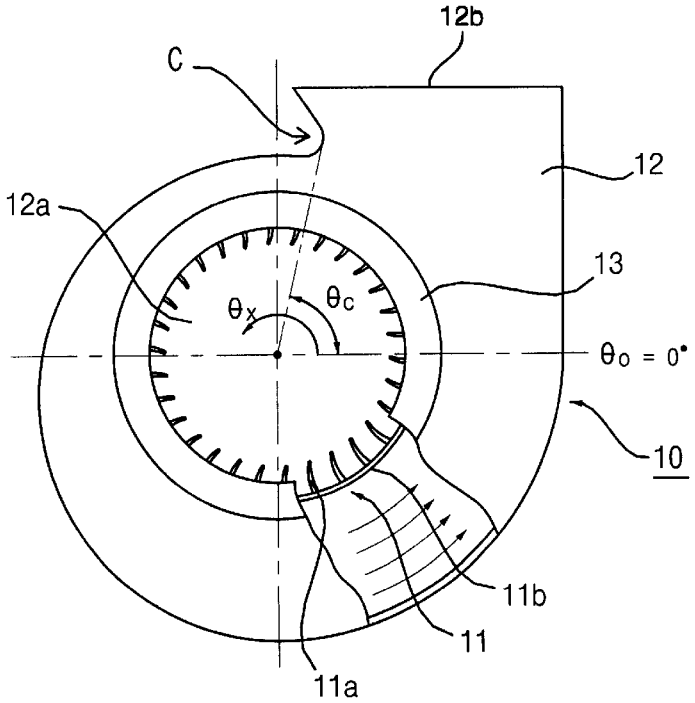
FIG. 2 ( Prior Art )
FIG. 2 is a cutaway front view showing a conventional blower.
Figure 3:
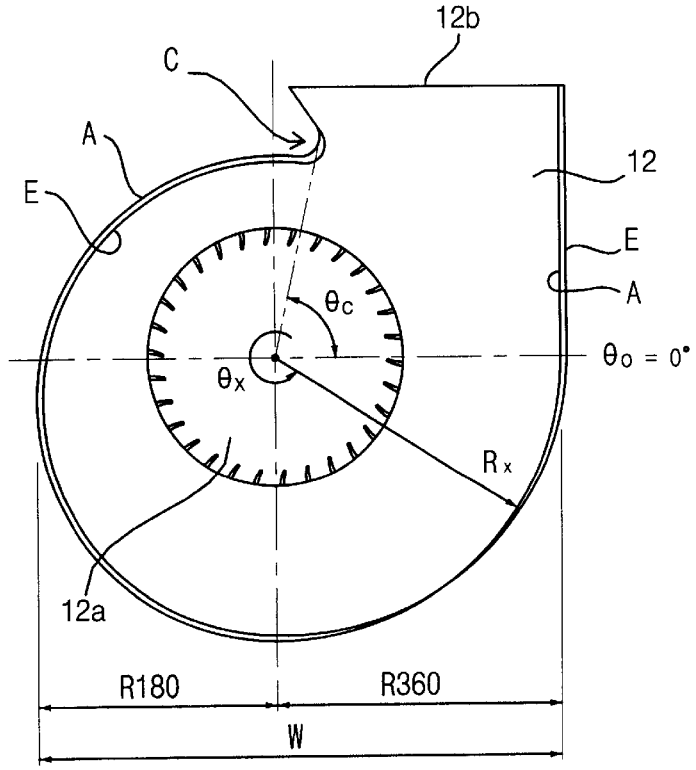
FIG. 3 ( Prior Art )
FIG. 3 is a front view showing the scroll housing of the conventional blower that is designed using an Archimedic curve and an exponential curve.
Figure 4:
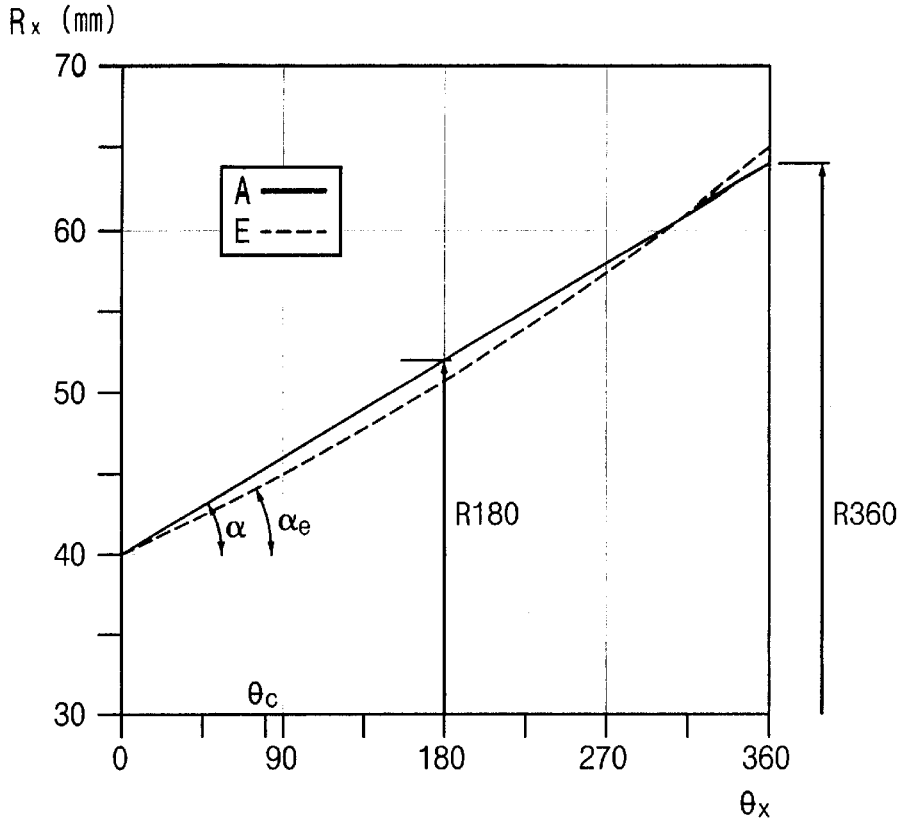
FIG. 4 ( Prior Art )
FIG. 4 is a graph wherein expansion angles are plotted for a case where the scroll housing of the conventional blower is designed using the Archimedic curve and the exponential curve.
Figure 5:
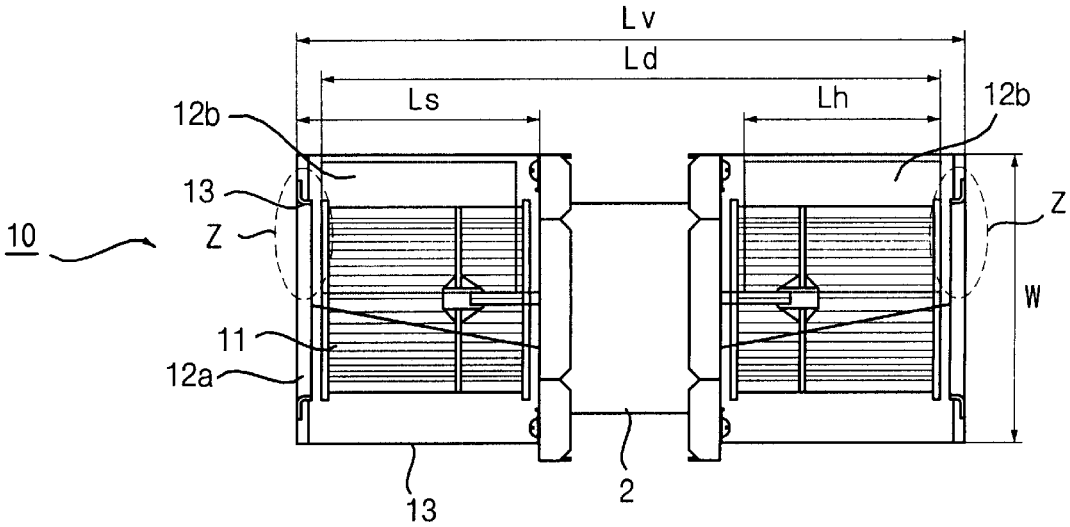
FIG. 5 ( Prior Art )
FIG. 5 is an enlarged view showing the blower in FIG. 1.
Figure 6:
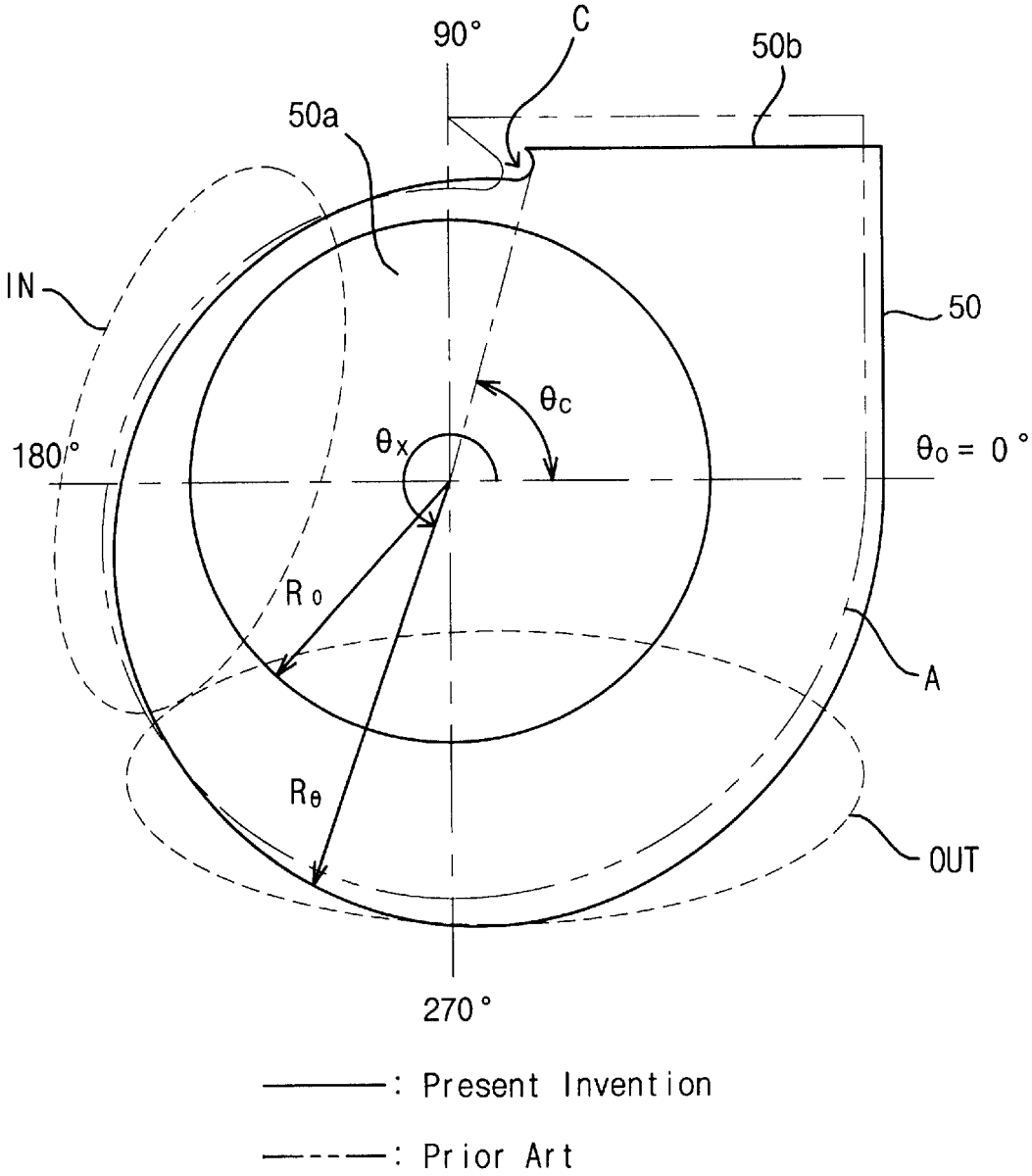
FIG. 6 is a front view showing the scroll housing of a blower in accordance with the present invention.
Figure 7:
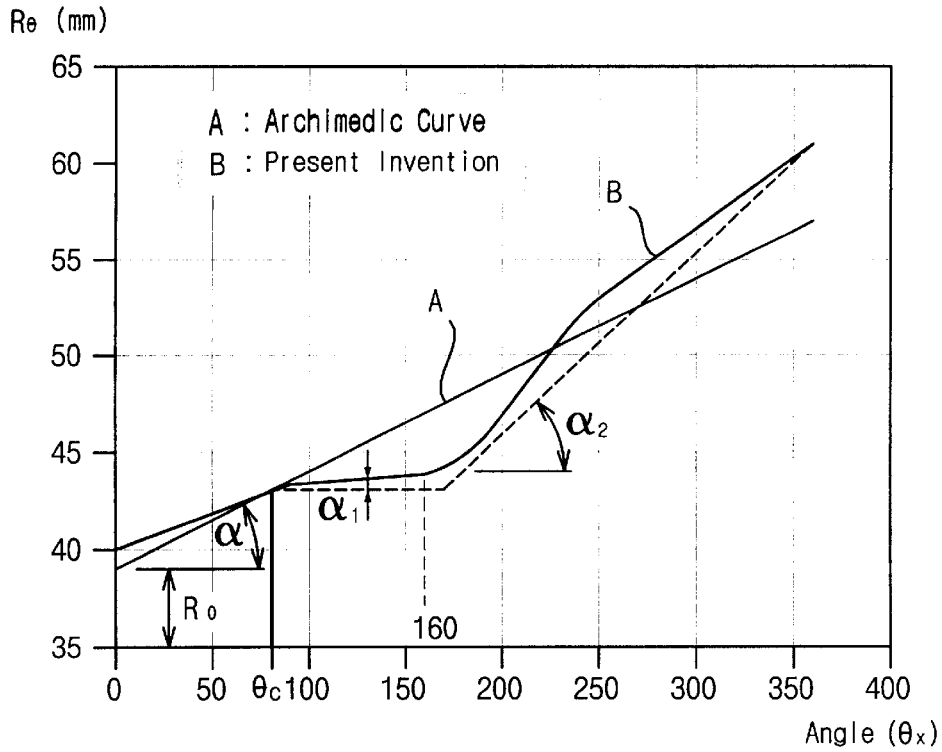
FIG. 7 is a graph on which the expansion angles of the blower are plotted.
Figure 8:
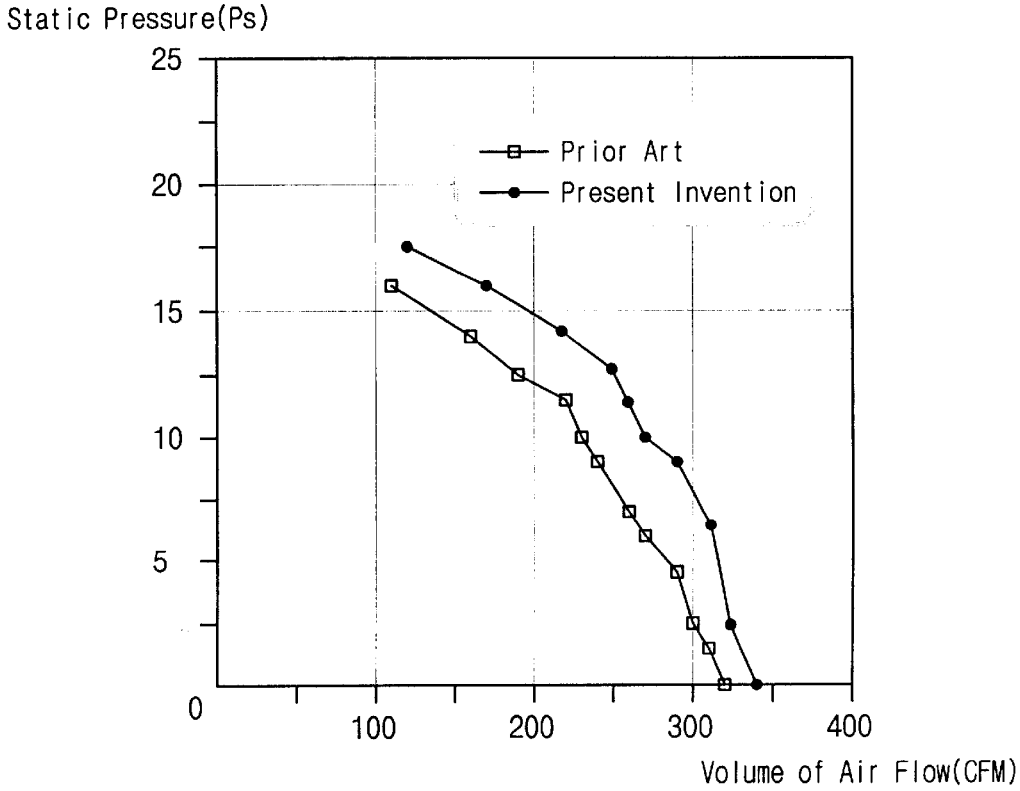
FIG. 8 is a graph on which the pressures and volume of air flow of the blower of the present invention and prior art are plotted.

FIG. 6 is a front view showing the scroll housing of a blower in accordance with the present invention. FIG. 7 is a graph on which the expansion angles of the blower are plotted. FIG. 8 is a graph on which the pressures and the volume of air flow of the blowers of the present invention and prior art are plotted.

As illustrated in FIGS. 6 and 7, in a scroll housing 50 that guides air sucked by an impeller (not shown) to a discharge opening 50*b*, when a reference angle $\theta_0$ is assigned with regard to a position where the contour curve of the scroll housing 50 ends and an optional angle $\theta_x$ from the reference angle is set up along an air flow direction, the expansion angle $\alpha 1$ of the scroll housing in a region ranging from a cutoff angle $\theta_c$ to $160° \geqq \theta_x \geqq 200°$ is designed to be less than the expansion angle $\alpha$ in conformity with an Archimedic curve, and the expansion angle $\alpha 2$ of the scroll housing in a region of which $\theta_x$ exceeding 160–200° is designed to be greater than the expansion angle $\alpha$ in conformity with an Archimedic curve.

That is, the curvature radius in the suction region IN of the scroll housing 50 is designed to be less than the curvature radius in conformity with the Archimedic curve, and the curvature radius in the discharge region OUT of the scroll housing 50 is designed to be greater than the curvature radius in conformity with the Archimedic curve. The contour curve of the scroll housing 50 is formed by deforming the Archimedic curve while varying expansion angles $\alpha 1$ and $\alpha 2$ differently in accordance with the optional angle $\theta_x$.

Although methods of designing the scroll housing may be various, the method in accordance with a preferred embodiment of the present invention is as follows.

The radius $R_{74\ 1}$ of a curvature in a suction region ranging from the cutoff start angle to 160–200° is designed in conformity with the following equation 3 or while the expansion angle $\alpha 1$ is kept less than the expansion angle $\alpha$ of the Archimedic curve, whereas the radius $R_{\theta 2}$ of a curvature in the discharge region exceeding 160–200° is designed in conformity with a following equation 4 while the expansion angle $\alpha 2$ is kept greater than the expansion angle $\alpha$ of the Archimedic curve.

$$R_{\theta 1}=R_o\times(1+\theta_x\times\pi/180\times\tan\alpha 1) \qquad \text{Equation 3}$$

$$R_{\theta 2}=[R_o\times(1+\theta_1\times\pi/180\times\tan\alpha 1)]\times(1+\theta_x\times\pi/180\times\tan\alpha 2)+\{-\delta\times(\theta_x-\theta_1)\times(\theta_x-360)\} \qquad \text{Equation 4}$$

wherein $R_o$ denotes the radius of the impeller, $\theta_x$ denotes an optional angle measured from the reference angle to an optional position past a cutoff start angle along the flow direction, $\theta_1$ denotes a certain angle within an angular range of 160–200°, $R_{\theta 1}$ and $R_{\theta 2}$ are curvature radiuses of the scroll housing at an angle of $\theta_x$ and respectively denote the curvature radius in a region where $\theta_x$ is equal to or less than $\theta_1$ and the curvature radius in a region where $\theta_x$ exceeds $\theta_1$, $\alpha 1$ denotes the expansion angle in a region ranging from the reference angle to an angle of $\theta_1$, $\alpha 2$ denotes the expansion angle in a region exceeding $\theta_1$, and $\delta$ denotes an optional constant.

If the width of the scroll housing is restricted to 105 mm, the curvature radiuses of the scroll housing of the present invention in a case where in the equations 3 and 4 $R_o$=40 mm, $\theta_1$=180°, $\alpha 1$=1.00, $\alpha 2$=9.55 and $\delta$=0.002 and the curvature radiuses of the scroll housing of the Archimedic curve in a case where in the equation 1 $R_o$=40 mm and $\alpha 1$=3.799 are compared in the following table.

TABLE 1 unit:mm

| Angle($\theta_x$) | Curvature radius in conformity with Archimedic curve ($R_x$) | Curvature radius in conformity with the present invention ($R_\theta$) |
|---|---|---|
| 90 | 40.10430 | 41.09673 |
| 120 | 45.56291 | 41.46231 |
| 150 | 46.95364 | 41.82789 |
| 180 | 48.34437 | 42.19347 |
| 210 | 49.73510 | 53.71686 |
| 240 | 51.12583 | 62.73707 |
| 270 | 52.51656 | 68.15728 |
| 300 | 53.90729 | 69.97750 |
| 330 | 55.29801 | 68.19771 |
| 360 | 56.68874 | 62.81792 |
| W180 + W360 | 105.0331 | 105.0114 |

The blower of the present invention is operated the same as the conventional blower. That is, as the impeller of the blower of the present invention is rotated, the air in front of an inlet 50*a* is sucked, moved through a passage, which is expanded gradually from the cutoff start angle $\theta_c$, and discharged through the discharge opening 50*b* to the outside. In such a case, since the expansion angle $\alpha 2$ of the present invention is greater than the expansion angle of the prior art in a region of which $\theta_x$ exceeding 160–200°, the curvature radius of the contour of the scroll housing 50 is increased, thereby increasing the volume of flow of discharged air.

FIG. 8 is a graph wherein the volume of flow of discharged air is plotted with regard to the pressures of the blower of the present invention and the prior art in conformity of the test results. In this graph, the volume of air flow in the blower of the present invention is increased in static pressure in comparison with the volume of air flow in the blower of the prior art.

Another embodiment of the present invention is illustrated in FIGS. 9 to 12.

Figure 9:
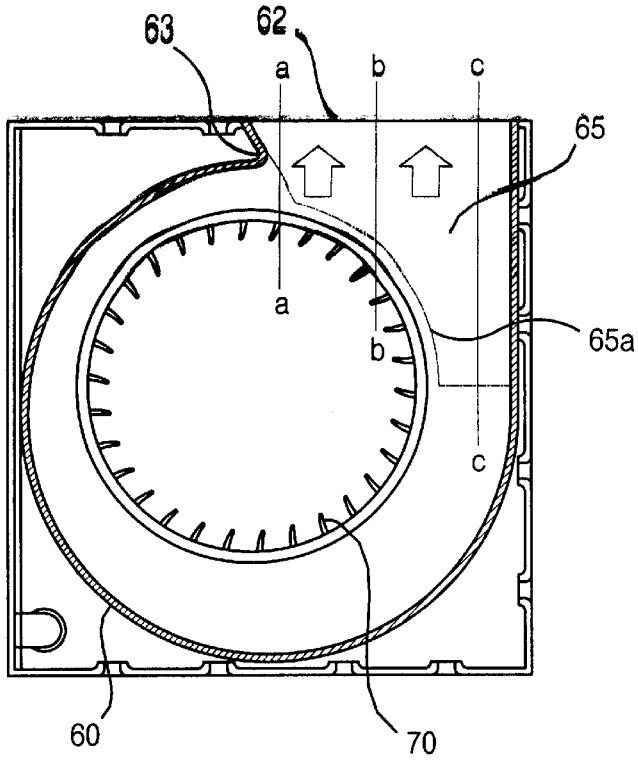
FIG. 9 is a sectional view showing the blower of the present invention.
Figure 10:
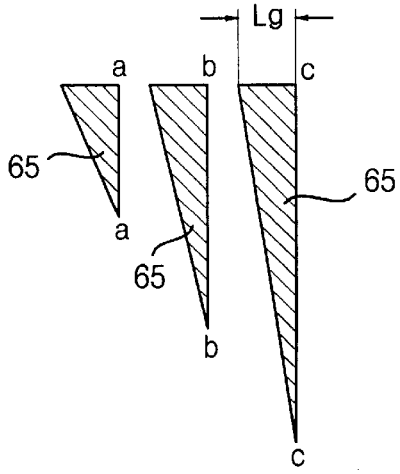
FIG. 10 is a sectional view taken along lines a—a, b—b and c—c of FIG. 9.
Figure 11:
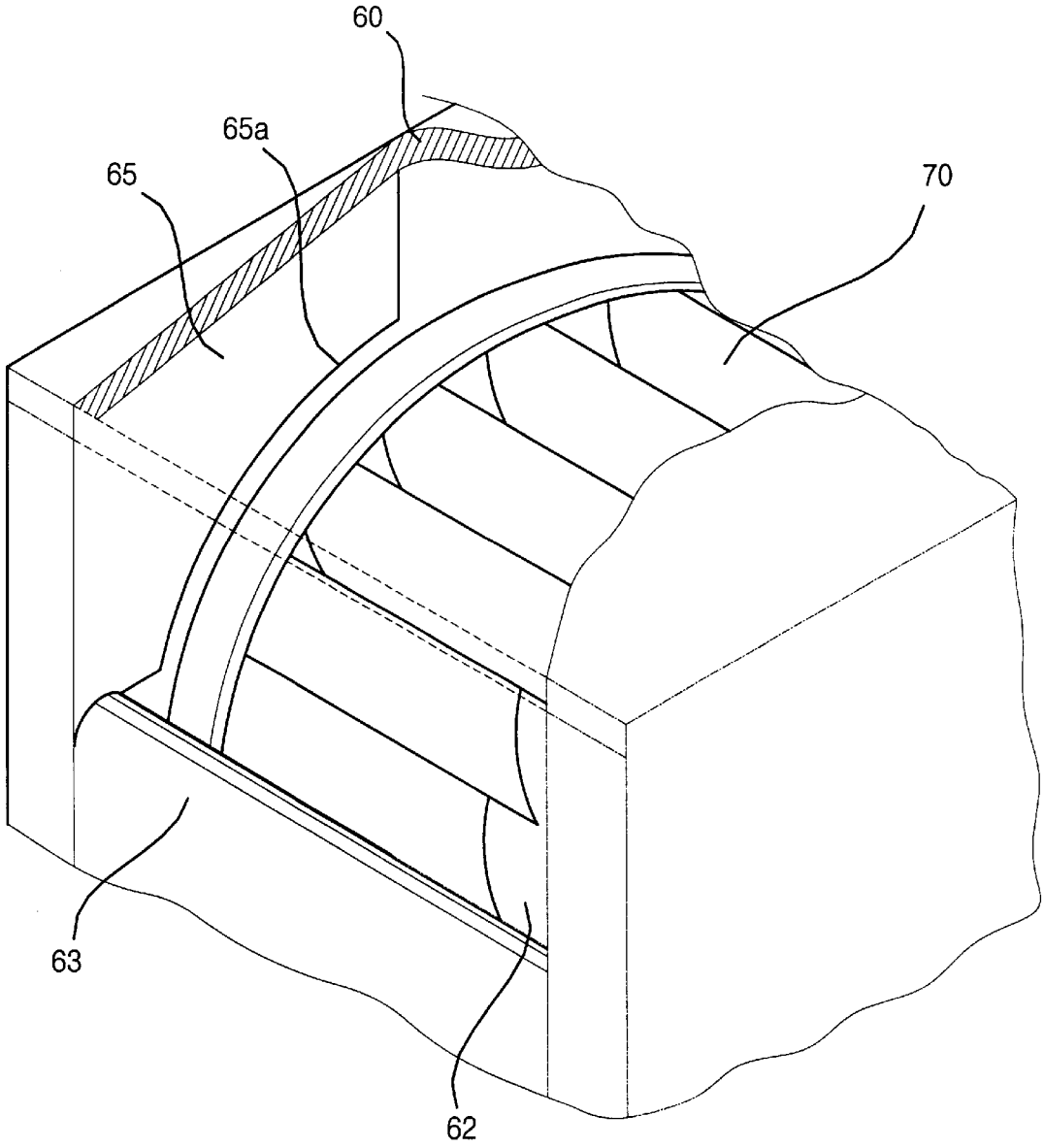
FIG. 11 is a cut-away perspective view showing the blower of the present invention.
Figure 12:
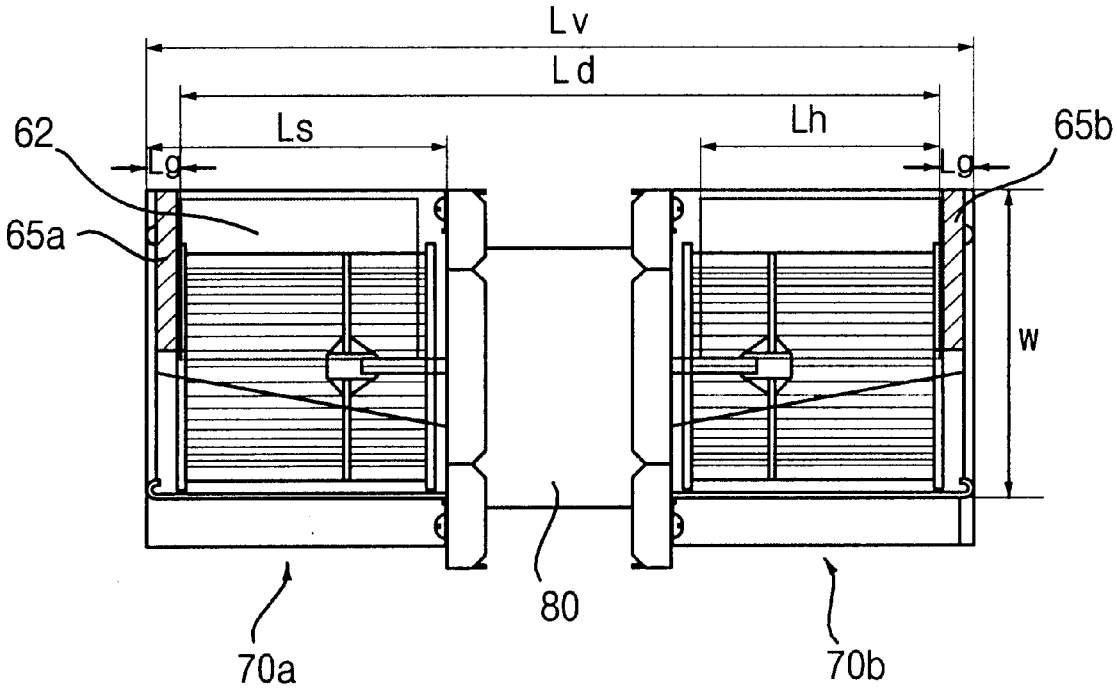
FIG. 12 is a front view showing the blower for a combined electronic range and hood in accordance with the present invention.

FIG. 9 is a sectional view showing the blower of the present invention. FIG. 10 is a sectional view taken along lines a—a, b—b and c—c of FIG. 9. FIG. 11 is a cut-away perspective view showing the blower of the present invention. FIG. 12 is a front view showing the blower for a combined electronic range and hood in accordance with the present invention.

As illustrated in FIGS. 9 and 11, the blower 10 of the present invention comprises an impeller 70 and a scroll housing 60. The scroll housing 60 is provided with a discharge opening 62 at its top so that air sucked by means of an impeller 52 is discharged to a connecting duct.

A discharge guide 65 is formed on the side portion of the scroll housing 62 beside the discharge opening 62.

The discharge guide 65 starts from the plane of the side portion of the scroll housing 62 and is gradually projected toward the discharge opening 62, thereby guiding airflow to the outside of the discharge opening 62 smoothly.

In such a case, the projected portion of the discharge guide 65 may be a plane surface or curved surface.

Additionally, the projected width of the discharge guide 65 is preferably within 20% of the length Ls of the scroll housing 62 and, in particular, 5 to 15%.

This is because as the projected width Lg of the discharge guide 65 is increased, the tilt angle of the discharge guide 65 is increased and, consequently, flow loss is increased.

As shown in FIG. 9, the discharge guide 65 is preferably formed in a region of 90° ranging from the cutoff 63 toward the discharge opening 62.

The discharge guide 65 starts in the form of a semicircle 65*a* and continues to the discharge opening 62.

As a result, as shown in FIGS. 9 and 10, a small triangular cross section is formed in the vicinity or the cutoff 63, and the larger triangular cross section is formed as it moves away from the cutoff 63.

The discharge guide 65 may be integrated with the side of the scroll housing 60 into a single body, or separately formed.

Although the width Ld of the connecting duct and the length LH of the discharge opening 62 are limited because the discharge guide 65 is formed on the discharge portion of the scroll housing 60, the total length Lv of the blower may be increased to be two times as large as the projected width La of the discharge guide 65, thereby increasing the volume of air flow.

According to the conventional art, when the total length Lv of the blower is increased, the sides of the scroll housing, that is, the sides of the discharge opening 62 are closed, thereby generating the excessive flow resistance of air. However, according to the present invention, since the total length Lv of the blower is increased properly and the discharge guides 65 is mounted to the outer side of the discharge opening 62, the flow resistance of air is minimized, thereby increasing the volume of air flow.

Referring to FIG. 12, the blower of the present invention used in conjunction with a combined electronic range and hood comprises a pair of sub-blowers 70*a* and 70*b* positioned at both sides of the motor 80 and a pair of discharge guides 65*a* and 65*b* respectively mounted to the outer sides of the blowers 70*a* and 70*b*. When the blower was operated under the conditions that the length Ls of the scroll housing is 106 mm and the projected width Lg of the discharge guide is 10 mm or 15 mm, the test results described in table 2 were obtained.

TABLE 2

| | Rotational speed of impeller | | | |
|---|---|---|---|---|
| | High speed | | Low speed | |
| | Volumn of Flow (CFM) | Noise (dB(A)) | Volumn of flow(CFM) | Noise (dB(A)) |
| Example 1 (Width of discharge guide: 10 mm) | 315 | 58.43 | 216 | 49.7 |
| Example 2 (Width of discharge guide: 15 mm) | 310 | 59.37 | 220 | 52.04 |
| Comparative Example (No discharge guide) | 298 | 59.97 | 202 | 51.37 |

From the above test results, it is known that when the projected width Lg of the scroll housing is designed to be 10–15% of the length of the scroll housing, the volume of air flow is increased and noise is decreased in comparison with a case where there is no discharge guide. However, when the width of the discharge guide is 15 mm and the impeller is rotated at a low speed, noise is somewhat increased, but noise is the same as or less than that of the case when compared in the basis of the same volume of air flow rate.

As described above, the present invention provides a blower, which is capable of increasing its blowing efficiency while reducing its noise, in such a way that the curvature radii of the contour of its scroll housing is designed to be less than that of the conventional scroll housing in a suction region IN that does not influence air flow rate, the curvature radius of the contour of its scroll housing is designed to be greater than that of the conventional scroll housing in a discharge region OUT that greatly influences air flow rate, discharge direction of air is mounted to the discharge opening of the scroll housing, by varying the expansion angle of its scroll housing.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A blower, comprising:

an impeller provided with a plurality of blades; and a scroll housing for guiding and discharging air sucked by the impeller to the outside, said scroll housing surrounding said impeller, wherein an expansion angle of a curvature radius of a contour of said scroll housing is designed to be less than an expansion angle $\alpha$ conformity with an Archimedic curve in a suction region ranging from a cutoff start angle to 160–200° from a reference angle being assigned to a position where the contour curve of the scroll housing ends so that the radius of the scroll housing is shorter than that of the Archimedic curve at a position of 180° from the reference angle by a predetermined length L and to be greater than the expansion angle a in conformity with the Archimedic curve in a discharge region range exceeding 160–200° from the reference angle, so that the radius of the scroll housing is longer than that of the Archimedic curve at a position of 360° of the reference angle by almost the predetermined length L.

2. A blower, comprising:

an impeller provided with a plurality of blades; and a scroll housing for guiding and discharging air sucked by the impeller to the outside, said scroll housing surrounding said impeller, wherein an expansion angle of a curvature radius of a contour of said scroll housing is designed to be less than an expansion angle in conformity with an Archimedic curve in a suction region ranging from a cutoff start angle to 160–200° from a reference angle being assigned to a position where the contour curve of the scroll housing ends and to be greater than the expansion angle in conformity with the Archimedic curve in a discharge region range exceeding 160–200° from the reference angle, said curvature radius of the contour of the scroll housing is calculated by the following equations:

$$R_{\theta 1}=R_o\times(1+\theta_x\times\pi/180\times\tan\alpha\mathbf{1})$$

$$R_{\theta 2}=[R_o\times(1+\theta_1\times\pi/180\times\tan\alpha\mathbf{1})]\times(1+\theta_x\times\pi/180\times\tan\alpha\mathbf{2})+\{-\delta\times(\theta_x-\theta_1)\times(\theta_x-360)\}$$

wherein $R_o$ denotes a radius of said impeller, $\theta_x$ denotes an optional angle measured from a reference angle to an optional position past a cutoff start angle along a flow direction, $\theta_1$ denotes a certain angle within an angular range of 160–200°, $R_{\theta 1}$ and $R_{\theta 2}$ respectively denote a curvature radius in a region where $\theta_x$ is equal to or less than $\theta_1$ and a curvature radius in a region where $\theta_x$ exceeds $\theta_1$, $\alpha\mathbf{1}$ denotes an expansion angle in a region ranging from the reference angle to an angle of $\theta_1$, $\alpha\mathbf{2}$ denotes an expansion angle in a region exceeding $\theta_1$, and $\delta$ denotes an optional constant.

3. A blower, comprising:

a scroll housing provided with a discharge opening;

an impeller positioned in said scroll housing; and guide means, mounted to a side wall of said scroll housing, said guide means being slight in thickness and short in height at a portion near said impeller, and increasing in thickness as it projects toward said discharge opening, having a final height approximately equal to the height of the discharge opening.

4. The blower according to claim 3, wherein said guide means has a curved portion in the vicinity of said impeller and maintains said curve as it is gradually projected toward the discharging opening of said scroll housing from the curved portion.

5. The blower according to claim 4, wherein said blower consists of two sub-blowers and said guide means consists of two discharge guides, said sub-blowers being positioned at both sides of a motor, said discharge guides being respectively mounted to outer sides of discharging openings of said sub-blowers.

6. The blower according to claim 3, wherein a maximum projected width of said guide means is less than 20% of a length of said scroll housing.

7. The blower according to claim 6, wherein a maximum projected width of said guide means is 5–15% of a length of said scroll housing.

8. The blower according to claim 6, wherein said blower consists of two sub-blowers and said guide means consists of two discharge guides, said sub-blowers being positioned at both sides of a motor, said discharge guides being respectively mounted to outer sides of discharging openings of said sub-blowers.

9. The blower according to claim 7, wherein said blower consists of two sub-blowers and said guide means consists of two discharge guides, said sub-blowers being positioned at both sides of a motor, said discharge guides being respectively mounted to outer sides of discharging openings of said sub-blowers.

10. The blower according to claim 3, wherein said blower consists of two sub-blowers and said guide means consists of two discharge guides, said sub-blowers being positioned at both sides of a motor, said discharge guides being respectively mounted to outer sides of discharging openings of said sub-blowers.

* * * * *